US009003803B2

(12) United States Patent
Pangle et al.

(10) Patent No.: US 9,003,803 B2
(45) Date of Patent: Apr. 14, 2015

(54) COMBUSTOR CAP ASSEMBLY

(75) Inventors: Ansley Michelle Pangle, Pickens, SC (US); Matthew Bernard Wilson, Greer, SC (US); William Michael Poschel, Greenville, SC (US)

(73) Assignee: General Electric Company, Schenectady, NY (US)

( * ) Notice: Subject to any disclaimer, the term of this patent is extended or adjusted under 35 U.S.C. 154(b) by 306 days.

(21) Appl. No.: 13/566,286

(22) Filed: Aug. 3, 2012

(65) Prior Publication Data

US 2014/0033717 A1 Feb. 6, 2014

(51) Int. Cl.
*F23R 3/28* (2006.01)
*F23R 3/60* (2006.01)

(52) U.S. Cl.
CPC .. *F23R 3/283* (2013.01); *F23R 3/60* (2013.01)

(58) Field of Classification Search
CPC ..... F23R 3/20; F23R 3/283; F23R 3/60
USPC ..... 60/737, 740, 746, 752, 756
See application file for complete search history.

(56) References Cited

U.S. PATENT DOCUMENTS

| | | | | |
|---|---|---|---|---|
| 5,274,991 | A | 1/1994 | Fitts | |
| 5,357,745 | A | 10/1994 | Probert | |
| 6,438,959 | B1 | 8/2002 | Dean et al. | |
| 6,910,336 | B2 | 6/2005 | Sullivan et al. | |
| 8,087,228 | B2 | 1/2012 | McMahan et al. | |
| 8,171,737 | B2 | 5/2012 | Johnson et al. | |
| 2006/0230763 | A1 * | 10/2006 | Johnson et al. | 60/740 |
| 2009/0188255 | A1 | 7/2009 | Green et al. | |
| 2010/0101232 | A1 | 4/2010 | Shi et al. | |

OTHER PUBLICATIONS

Search Report and Written Opinion from PCT/2013/053146 dated Sep. 20, 2013.

* cited by examiner

*Primary Examiner* — Gerald L Sung
*Assistant Examiner* — Scott Walthour
(74) *Attorney, Agent, or Firm* — Nixon & Vanderhye, P.C.

(57) ABSTRACT

A support structure for a burner tube in a combustor cap assembly for a gas turbine combustor includes an outer annular ring; an inner annular hub; and a plurality of struts extending radially between said outer annular ring and the inner hub. The inner hub is provided with a piston ring groove and a piston ring adapted to receive and seal an inner end of the burner tube.

20 Claims, 5 Drawing Sheets

COMBUSTOR CAP ASSEMBLY

BACKGROUND OF THE INVENTION

The invention relates to gas turbine combustion technology and, more specifically, to a simplified design for a combustor cap assembly.

In certain can-annular combustor arrangements in land-based electrical power generation gas turbines, combustor cap assemblies are provided at the forward or upstream end of the combustor and serve to support fuel nozzles projecting into the combustion chamber. Typically, the combustor cap assemblies support plural fuel nozzles at two locations including the forward ends of the nozzles and the aft ends of the nozzles and/or burner tubes that surround the nozzles. In some configurations, only a center fuel nozzle is surrounded by a burner tube, whereas in other configurations all of the combustor nozzles are surrounded by respective burner tubes.

In certain known arrangements, the combustor cap assembly at the aft end where the cap assembly (i.e., the end closest to the combustion chamber) interfaces with the aft ends of the fuel nozzles and/or burner tubes, there is an effusion plate provided with plural apertures, each surrounded by a piston ring sleeve that telescopically receives the aft end of the burner tube. Typically, the piston ring sleeve is butt-welded to the effusion plate as part of the cap assembly and the burner tube is received over the piston sleeve, with a hula seal radially therebetween. A support structure, which has inner and outer rings connected by plural spokes or struts, is positioned around the end of the piston ring sleeve adjacent the effusion plate and welded into place. The burner tube sleeve is fillet-welded to a backing plate at the opposite or upstream end of the cap assembly.

The current design is complex and requires multiple parts which can result in inefficiencies in assembly, repairs, etc. There remains a need, therefore, for a simplified combustor cap assembly design that reduces the number of parts and facilitates assembly/disassembly but without any degradation of structural integrity.

BRIEF SUMMARY OF THE INVENTION

In accordance with an exemplary but nonlimiting embodiment, there is provided a support structure for a burner tube in a combustor cap assembly for a gas turbine combustor comprising: an outer annular ring; an inner annular hub; and a plurality of struts extending radially between the outer annular ring and the inner hub; wherein the inner hub is provided with a piston ring groove and a piston ring adapted to receive and seal an inner end of the burner tube.

In another aspect, there is provided a combustor cap assembly comprising: a support structure for a combustor cap assembly at forward and aft ends thereof for supporting a plurality of fuel nozzles and surrounding burner tubes, including a center nozzle and a center burner tube, the support structure at the aft end including: an effusion plate having a center opening defined in part by a sleeve facing the forward end and a wagon-wheel structure having an outer annular ring; and a plurality of struts extending radially between the outer annular ring and the inner hub; wherein the inner hub is provided with a piston ring groove and a piston ring adapted to receive and seal an inner end of the burner tube.

In still another aspect, there is provided a combustor cap assembly comprising a support structure for a combustor cap assembly at forward and aft ends thereof for supporting a plurality of fuel nozzles and surrounding burner tubes, including a center nozzle and a center burner tube the support structure at the aft end including: an effusion plate having a center opening defined in part by a sleeve facing the forward end and a wagon-wheel structure having an outer annular ring and an inner hub; a plurality of struts extending radially between the outer annular ring and the inner hub; wherein the inner hub is provided with a piston ring groove and a piston ring adapted to receive and seal an inner end of the center burner tube; and the effusion plate is provided with a circular center opening defined by a forward-facing edge, and wherein said aft end of said inner hub is attached to said forward-facing edge.

The invention will now be described in detail in connection with the drawings identified below.

DETAILED DESCRIPTION OF THE INVENTION

Figure 1:
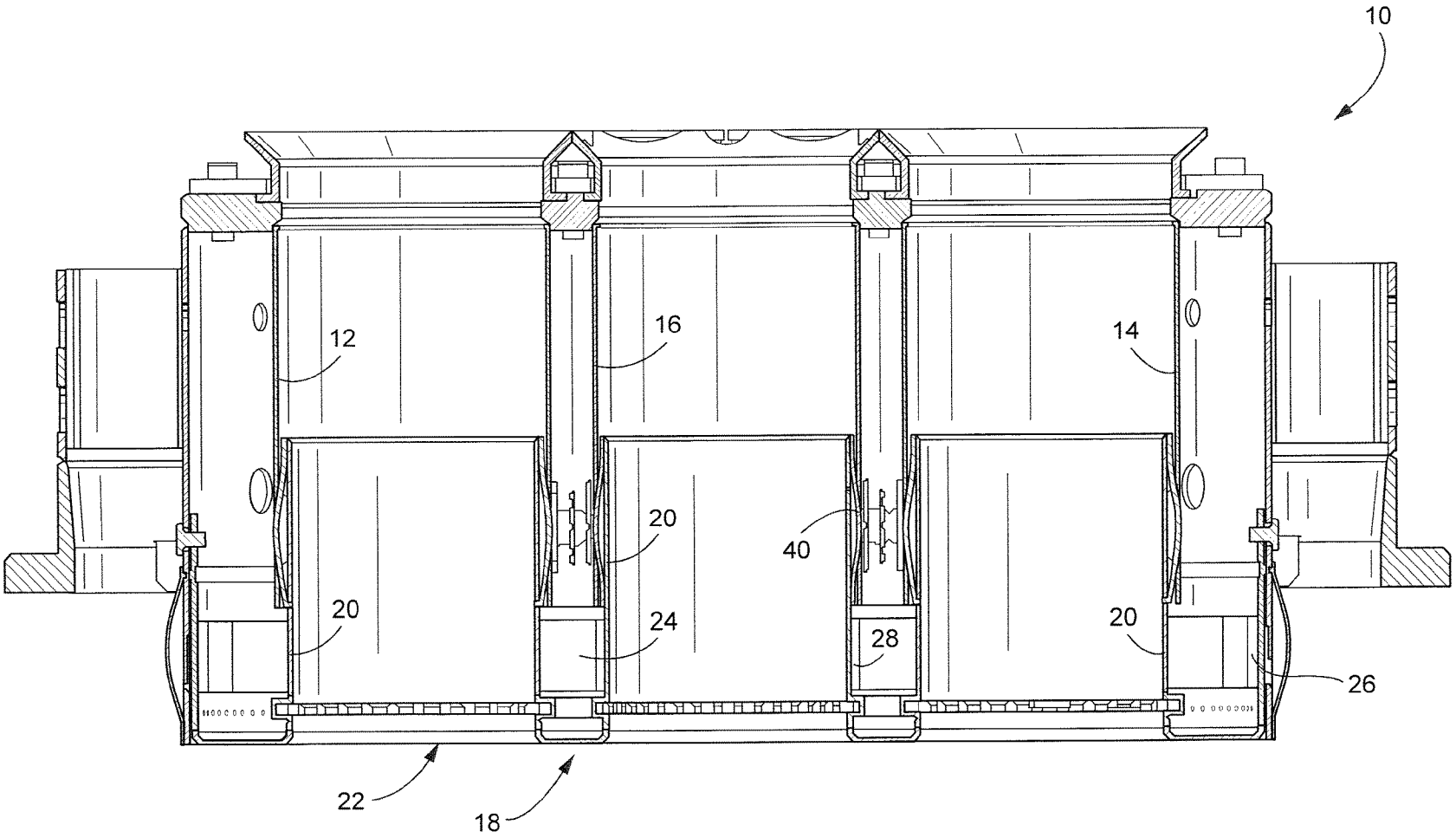
FIG. 1 (Prior Art)
FIG. 1 is a cross-section through a combustor cap assembly in accordance with a known configuration.

FIG. 1 illustrates a known combustor cap assembly 10 for supporting a plurality of fuel nozzles (not shown) in an arrangement where five outer nozzles surround a center nozzle. In this particular example, all of the nozzles are provided with surrounding or outer burner tubes that are supported on an aft end of the combustor cap assembly. In FIG. 1, two outer nozzle burner tubes 12 and 14 are shown along with a center burner tube 16. The invention here relates particularly to the support for the center burner tube 16 at the inner or aft end 18 of the cap assembly 10. Accordingly, in describing the known arrangement shown in FIG. 1, the focus will be on the center burner tube 16 and its interaction with the inner or aft end 18 of the combustor cap assembly.

At their inner or forward ends (the ends facing or adjacent the combustion chamber), the various burner tubes are supported by sleeves 20 welded to an effusion plate 22. The center sleeve (also referred to herein as a "piston sleeve") 20 is also laterally supported by a "wagon-wheel" structure 24 (best seen in FIGS. 2 and 3) formed by an outer ring 26 and an inner ring or hub 28 connected by a plurality (five in the example illustrated) of radially-extending spokes or struts 30. With this arrangement, it will be appreciated that the five surrounding nozzles/burner tubes are each located within the space defined by a pair of adjacent struts 30.

Figure 2:
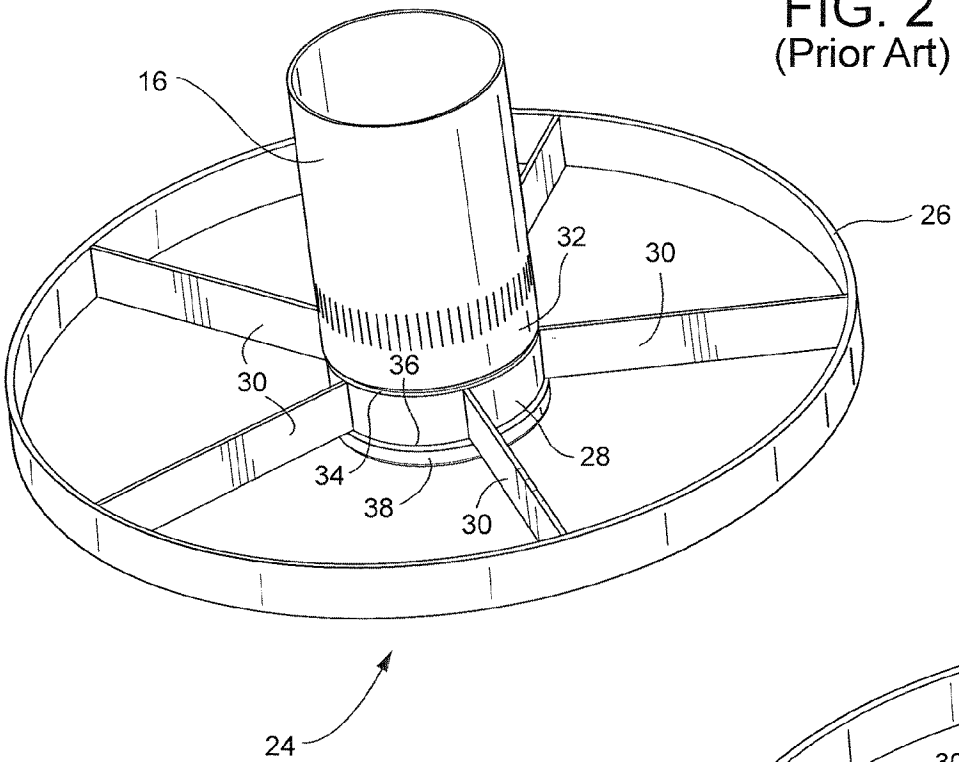
FIG. 2 (Prior Art)
FIG. 2 is a nozzle burner tube support structure taking from the cap assembly of FIG. 1.
Figure 3:
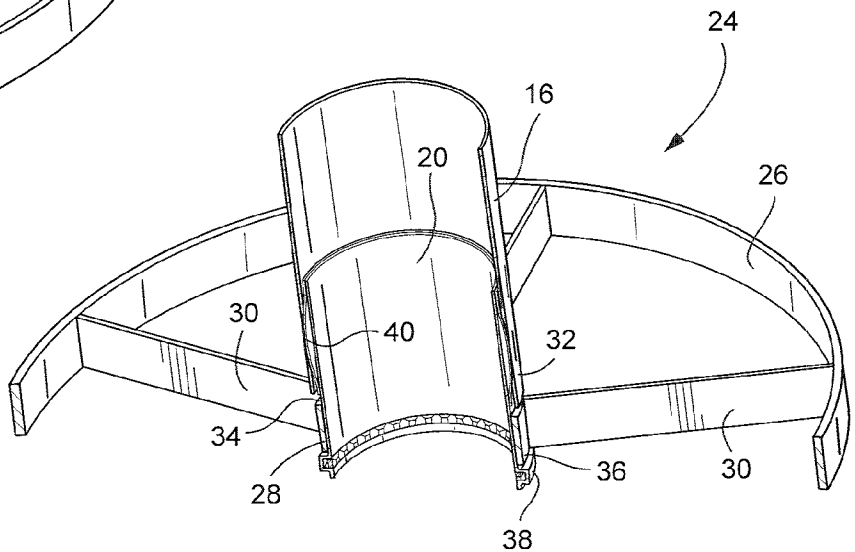
FIG. 3 (Prior Art)
FIG. 3 is a partial cut-away of the support structure shown in FIG. 2.

With continued reference to FIGS. 2 and 3, the inner hub 28 fits over the piston sleeve 20, and the center burner tube 16 is telescoped over the piston sleeve, such that the inner end 32 of the burner tube 16 is located in close proximity to the outer edge 34 of the inner hub 28, with an axial gap therebetween. Note also that there is a similar axial gap between the inner edge 36 of the inner hub 28 and the flanged base 38 of the piston sleeve 20. These gaps allow for thermal growth during operation. In this known arrangement, an annular, conventional spring or "hula seal" 40 is located radially between the inner end of the burner tube 16 and the piston sleeve 20 to minimize air leakage across the effusion plate.

Figure 4:
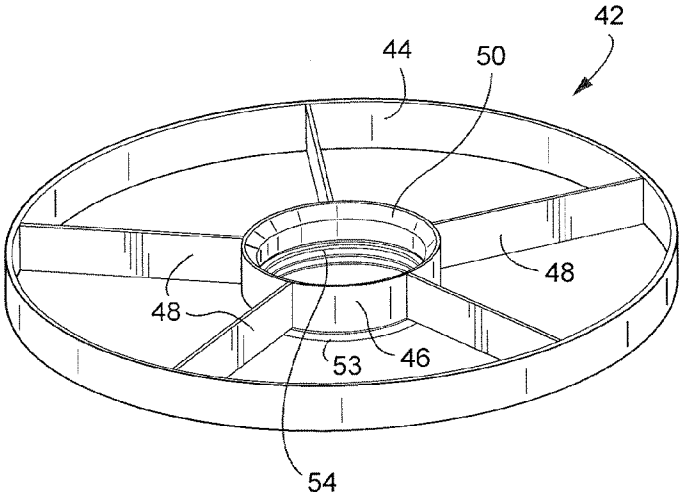
FIG. 4 is a nozzle burner support structure in accordance with an exemplary but nonlimiting embodiment of the invention.
Figure 5:
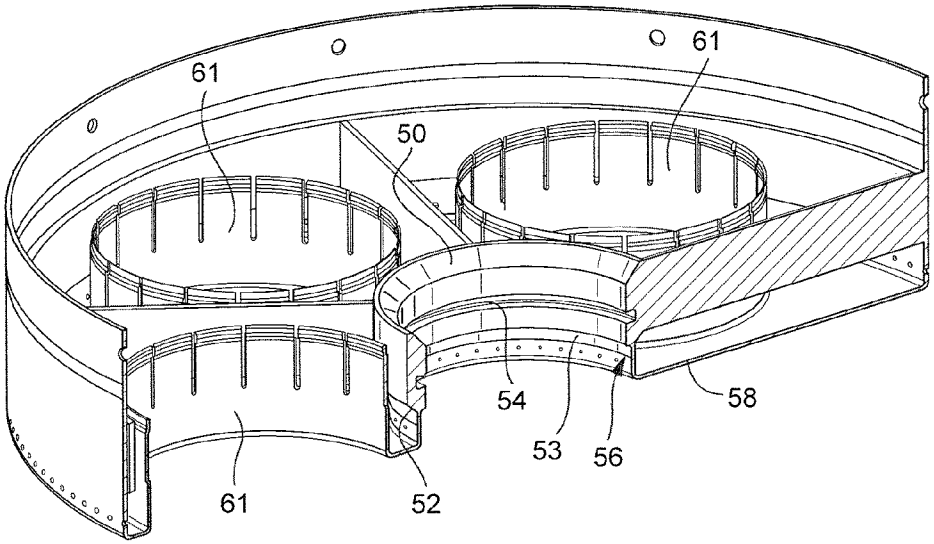
FIG. 5 is a partial section of a nozzle burner tube support structure in accordance with the invention, and showing additional supports for surrounding nozzles.
Figure 6:
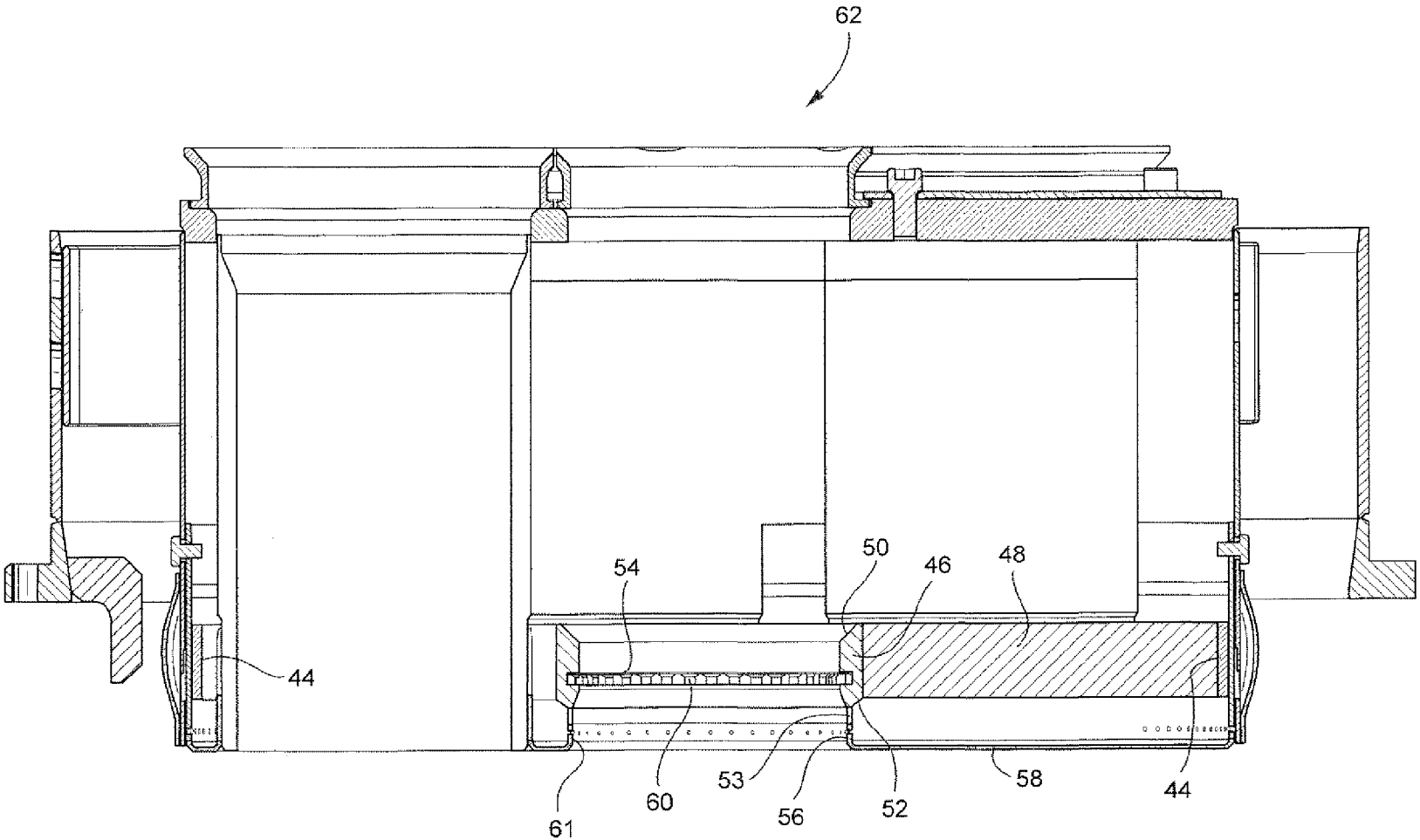
FIG. 6 is a partial cross-section through a combustor cap assembly incorporating the nozzle burner tube support structure of FIG. 4.

FIGS. 4 and 5 illustrate a simplified arrangement for supporting the inner end of a center burner tube 66 on the fuel nozzle assembly (see FIG. 7) in accordance with an exemplary but nonlimiting embodiment of the invention. A center burner, inner wagon-wheel structure 42 is formed by an outer annular ring 44 and an inner ring or hub 46 with a plurality of radially-extending spokes or struts 48 therebetween. In this case, however, the inner hub 46 is constructed so as to eliminate the need for a separate piston sleeve and hula seal. In addition, the center burner tube 66 is supported at the forward end of the nozzle assembly (FIG. 7) and merely sealed at the wagon-wheel structure 42. Specifically, the inner hub 46 has tapered forward and aft ends 50, 52 respectively, and an inner diameter formed with an annular piston ring groove 54 axially between the ends 50, 52. As best seen in FIGS. 5 and 6, a depending annular skirt portion 53 of the aft tapered end 52 may be butt-welded to a complementary edge 56 in the effusion plate 58. The forward-tapered end 50 facilitates the telescoping of the center fuel nozzle burner tube 66 into the inner hub 46 and a piston ring 60, seated in the groove 54, seals the interface between the fuel nozzle burner tube 66 and the inner hub 46.

FIG. 5 also shows surrounding burner tube support sleeves 61 of a different configuration than shown in FIG. 1 but is not intended to in any way limit the burner tube support structure described above.

Figure 7:
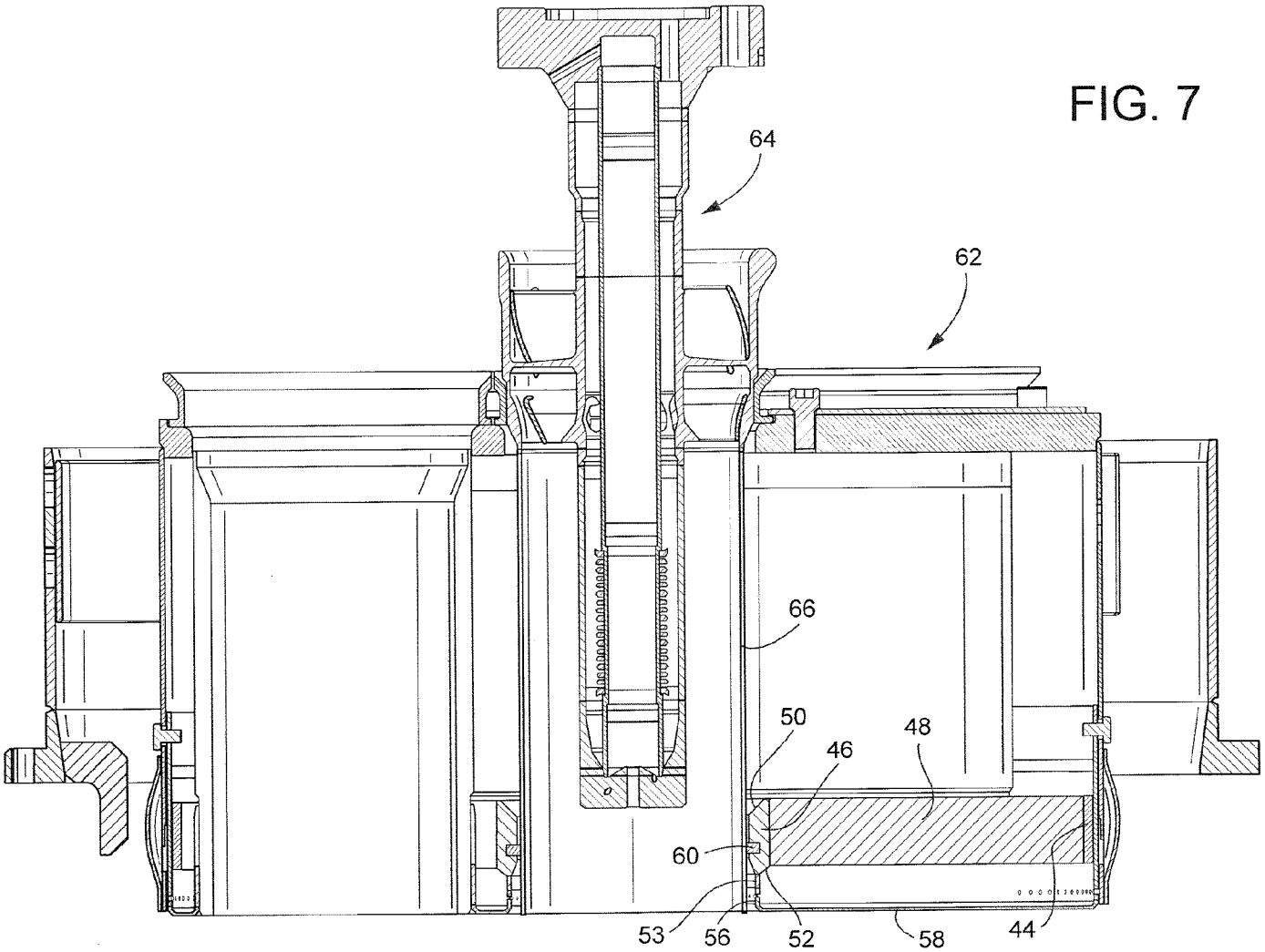
FIG. 7 is a view similar to FIG. 6 but also illustrating a center nozzle installed within the nozzle burner tube.

FIGS. 6 and 7 show the wagon-wheel support structure 42 incorporated into a combustor cap assembly 62, and FIG. 7 shows the same cap assembly 62 with a center nozzle 64 installed and extending into the center fuel nozzle burner tube 66.

The aft end of the fuel nozzle burner tube is sealed at the piston ring 60 but is otherwise unsecured where the burner tube is engaged by the effusion plate 58. This arrangement allows the fuel nozzle burner tube to grow thermally in at least an axial direction relative to the inner hub 46 and the effusion plate while the seal at the piston ring 60 is maintained.

This arrangement provides effective support for the inner end of the center burner tube with fewer parts and with simplicity of design with no reduction in structural integrity. While described herein in connection with a center nozzle burner tube, the invention has applicability in any nozzle burner tube, even without the "wagon-wheel" support structure. In other words, a support similar to the inner ring or hub 46, could be welded to the effusion plate at any location where a nozzle burner tube is to be supported.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A support structure for a burner tube in a combustor cap assembly for a gas turbine combustor comprising:

an outer annular ring;

an inner annular hub; and a plurality of struts extending radially between said outer annular ring and said inner annular hub, wherein an end of each strut is directly attached to an outer surface of the inner annular hub and an inner surface of the inner annular hub is configured to receive said burner tube;

an annular piston ring groove formed in the inner surface of the inner annular hub, and a piston ring seated in the piston ring groove and adapted to receive and seal an inner end of the burner tube, the piston ring located radially between the inner annular hub and the burner tube;

wherein said burner tube is radially outer to, and encircles, a fuel nozzle.

2. The support structure of claim 1 wherein said inner annular hub is formed with tapered portions on forward and aft ends thereof, the tapered portions being tapered towards a center of the inner annular hub.

3. The support structure of claim 2 wherein said piston ring groove is formed axially between said opposite forward and aft ends.

4. The support structure of claim 2 in combination with an effusion plate, said effusion plate having a circular opening defined by a forward-facing tapered edge, and wherein said aft end of said inner annular hub is welded to said forward-facing tapered edge on said effusion plate.

5. The support structure of claim 1 wherein said plurality of struts comprises five struts and wherein said burner tube comprises a center nozzle burner tube.

6. The support structure of claim 4 wherein said circular opening in said effusion plate is formed in a center portion of said effusion plate, with plural openings in the effusion plate surrounding said circular opening.

7. The support structure of claim 6 wherein each of said plural openings has a forward-facing support sleeve adapted to receive a peripheral burner tube, each forward-facing support sleeve having an inner piston ring groove fitted with a piston ring adapted to engage the peripheral burner tube.

8. A combustor cap assembly comprising:

a support structure for the combustor cap assembly at forward and aft ends thereof for supporting a plurality of fuel nozzles and surrounding burner tubes, including a center nozzle and a center burner tube;

the support structure at said aft end including an effusion plate having a circular opening defined in part by a sleeve facing said forward end and a wagon-wheel structure having an outer annular ring and an inner annular hub; and a plurality of struts extending radially between said outer annular ring and said inner annular hub and the struts being directly attached to the inner annular hub;

a piston ring groove in a radially inward surface of said inner annular hub, and a piston ring seated in the piston ring groove of the inner annular hub, the piston ring located radially between the inner annular hub and the burner tube, wherein the piston ring is adapted to receive and seal an inner end of the burner tube.

9. The combustor cap assembly of claim 8 wherein said inner annular hub is formed with tapered edges on opposite forward and aft ends thereof, the tapered portions being tapered towards a center of the inner annular hub.

10. The combustor cap assembly of claim 9 wherein said piston ring groove is formed axially between said opposite forward and aft ends.

11. The combustor cap assembly of claim 8, the circular opening of said effusion plate being defined by a forward-facing tapered edge, and wherein said aft end of said inner annular hub is welded to said forward-facing tapered edge on said effusion plate.

12. The combustor cap assembly of claim 8 wherein said plurality of struts comprises five struts extending radially from a center axis of the inner annular hub and arranged symmetrically about the center axis.

13. The combustor cap assembly of claim 11 wherein said circular opening in said effusion plate is formed in a center portion of said effusion plate, with plural openings surrounding said circular opening.

14. The combustor cap assembly of claim 8 wherein inner ends of said burner tubes are unconstrained to thereby permit thermal growth in an axial direction.

15. A combustor cap assembly comprising:

a support structure for the combustor cap assembly at forward and aft ends thereof for supporting a plurality of fuel nozzles and surrounding burner tubes, including a center nozzle and a center burner tube;

the support structure at said aft end including:

an effusion plate having at least one circular opening defined in part by a sleeve facing said forward end; and a wagon-wheel structure having an outer annular ring and an inner annular hub; and a plurality of struts extending radially between said outer annular ring and said inner annular hub;

a piston ring groove in a radially inward surface of said inner annular hub;

a piston ring seated in the piston ring groove and adapted to receive and seal an inner end of said center burner tube, the piston ring located radially between the inner annular hub and the burner tube; and the at least one circular opening includes a central circular opening defined by a forward-facing tapered edge of said sleeve, and wherein said aft end of said inner annular hub is attached to said forward-facing tapered edge.

16. The combustor cap assembly of claim 15 wherein said central circular opening is surrounded by plural openings adapted to receive peripheral burner tubes associated with peripheral fuel nozzles.

17. The combustor cap of assembly of claim 16 wherein each of said plural openings is formed with a forward-facing support sleeve adapted to receive a respective one of said peripheral burner tubes, each forward-facing support sleeve having an inner piston ring groove fitted with a piston ring adapted to engage said respective one of said perpheral burner tubes.

18. The combustor cap of assembly of claim 15 wherein said aft end of said inner annular hub is welded to said forward-facing tapered edge.

19. The combustor cap assembly of claim 15 wherein an aft end of said center burner tube is free to thermally grow relative to said inner annular hub and said sleeve.

20. The combustor cap assembly of claim 15 wherein aft ends of each of said burner tubes are free to thermally grow relative to said sleeve.

* * * * *

UNITED STATES PATENT AND TRADEMARK OFFICE

CERTIFICATE OF CORRECTION

PATENT NO. : 9,003,803 B2
APPLICATION NO. : 13/566286
DATED : April 14, 2015
INVENTOR(S) : Ansley Michelle Pangle et al.

It is certified that error appears in the above-identified patent and that said Letters Patent is hereby corrected as shown below:

In the Claims

At Column 6, line 11, Claim 17, reads --The combustor cap of assembly of claim 16 wherein--, should read "The combustor cap assembly of claim 16 wherein".

At Column 6, line 16, Claim 17, reads --adapted to engage said respective one of said perpheral burner--, should read "adapted to engage said respective one of said peripheral burner".

At Column 6, line 18, Claim 18, reads --The combustor cap of assembly of claim 15 wherein--, should read "The combustor cap assembly of claim 15 wherein".

Signed and Sealed this
Twenty-ninth Day of September, 2015

Michelle K. Lee

Michelle K. Lee
*Director of the United States Patent and Trademark Office*